US011555284B1

(12) United States Patent
Smith

(10) Patent No.: US 11,555,284 B1
(45) Date of Patent: Jan. 17, 2023

(54) INTEGRATING ARTICULATED CONCRETE BLOCKS WITH GABION/RENO CAGES

(71) Applicant: Lee A. Smith, Houston, TX (US)

(72) Inventor: Lee A. Smith, Houston, TX (US)

( * ) Notice: Subject to any disclaimer, the term of this patent is extended or adjusted under 35 U.S.C. 154(b) by 0 days.

(21) Appl. No.: 17/356,428

(22) Filed: Jun. 23, 2021

Related U.S. Application Data

(60) Provisional application No. 63/122,524, filed on Dec. 8, 2020.

(51) Int. Cl.
*E02B 3/14* (2006.01)
*E02D 29/02* (2006.01)
*E02B 3/12* (2006.01)

(52) U.S. Cl.
CPC ..... *E02B 3/14* (2013.01); *E02B 3/123* (2013.01); *E02B 3/124* (2013.01); *E02B 3/126* (2013.01); *E02D 29/0208* (2013.01)

(58) Field of Classification Search
CPC ..... E02D 29/0208; E02D 17/20; E02B 3/14; E02B 3/123; E02B 3/124; E01F 8/025
See application file for complete search history.

(56) References Cited

U.S. PATENT DOCUMENTS 1,987,150 A * 1/1935 Mason ..... E02B 3/123 405/20
3,990,247 A * 11/1976 Palmer ..... E02B 3/14 428/116
4,477,206 A 10/1984 Papetti et al.
4,572,705 A 2/1986 Vignon et al.
4,655,637 A * 4/1987 Vignocchi ..... E02D 29/0208 405/32
4,726,708 A 2/1988 Papetti
4,804,293 A 2/1989 Varkonyi et al.
5,556,230 A * 9/1996 Turk ..... E02B 3/129 405/21
5,636,938 A * 6/1997 Ragazzo ..... E02D 29/0208 405/15
5,823,709 A 10/1998 Maher et al.
5,882,453 A 3/1999 Stark
7,431,536 B2 10/2008 Benda
8,123,435 B1 2/2012 DeShaw et al.
8,262,318 B2 9/2012 Olsta et al.
8,678,705 B1 3/2014 Smith et al.
9,499,950 B1 * 11/2016 Smith ..... B28B 7/0079
9,797,106 B1 * 10/2017 Smith ..... E02B 3/14
10,113,285 B2 10/2018 Nadeau
(Continued)

OTHER PUBLICATIONS

Lifetime Pavers; "Paver Cross Section"; all; Feb. 9, 2016 (Year: 2016).*

(Continued)

*Primary Examiner* — Benjamin F Fiorello
(74) *Attorney, Agent, or Firm* — Roger N. Chauza, PC

(57) ABSTRACT

An articulated concrete block system that includes a gabion mattress drainage layer. The two major components of the system reduce the effects of erosion and increase the hydraulic stability in areas that experience high velocity water flows, hydraulic jumps, and will dissipate wave energy action for shoreline and coastal erosion. Geosynthetics are first placed on the ground surface, followed by a gabion mattress drainage layer, a smaller aggregate layer for fine grading, another optional geosynthetic layer, and then the articulated concrete blocks overlie the system.

20 Claims, 5 Drawing Sheets

(56) References Cited

U.S. PATENT DOCUMENTS

| | | | | |
|---|---|---|---|---|
| 10,285,340 | B2 | 5/2019 | Manning et al. | |
| 10,718,096 | B2 | 7/2020 | Li et al. | |
| 10,738,425 | B2 | 8/2020 | Heselden | |
| 10,781,569 | B2 | 9/2020 | Thomas et al. | |
| 2001/0002968 | A1* | 6/2001 | Black | E02D 29/0208 405/15 |
| 2003/0022134 | A1 | 1/2003 | Seniuk | |
| 2010/0111611 | A1 | 5/2010 | Olsta et al. | |
| 2012/0315089 | A1* | 12/2012 | Burns | E02B 3/04 405/16 |
| 2013/0031852 | A1* | 2/2013 | Hill | E04C 1/395 52/302.1 |
| 2014/0255097 | A1* | 9/2014 | van den Berg | E02D 17/20 405/16 |
| 2015/0204039 | A1 | 7/2015 | Scott | |
| 2015/0299977 | A1 | 10/2015 | Heselden | |
| 2018/0044057 | A1 | 2/2018 | Scott | |
| 2018/0087230 | A1* | 3/2018 | Hill | E02B 3/14 |
| 2019/0234042 | A1* | 8/2019 | Burkett | E02B 3/124 |
| 2019/0376248 | A1* | 12/2019 | Wilkinson | E02B 3/04 |
| 2020/0080273 | A1* | 3/2020 | Li | E02D 29/0208 |

OTHER PUBLICATIONS

Ghisi et al.; "The Use of Permeable Interlocking Concrete Pavement to Filter Stormwater for Non-Potable Uses in Buildings" all; Jul. 18, 2020 (Year: 2020).*

Maccaferri Technical Data Sheet of Gabion Mat, Jun. 30, 2013.

The Presto Advantage—Geoweb system with Geocells, 2012.

* cited by examiner

INTEGRATING ARTICULATED CONCRETE BLOCKS WITH GABION/RENO CAGES

RELATED APPLICATION

This non-provisional patent application claims the benefit of provisional application Ser. No. 63/122,524 filed Dec. 8, 2020.

TECHNICAL FIELD OF THE INVENTION

The present invention relates in general to apparatus and techniques for preventing erosion of soil subject to torrential water flow conditions, and more particularly to the use of gabion/reno wire cages in conjunction with articulated concrete blocks.

BACKGROUND OF THE INVENTION

Articulated Concrete Block systems (ACB) have been utilized in the United States since the early 1980's. This type of block system incorporates the use of cables to form pre-assembled mats that can be lifted via spreader bars with heavy equipment to place the pre-assembled mats on the soil surface to protect the same from erosion. In the 1990's improved articulated concrete block systems were invented and did not require the use of cables. Rather, the improved blocks were fabricated with interlocking tabs and sockets that resisted horizontal displacement, and thus could be installed by hand.

Rock drainage layers have been utilized even longer and are placed underneath Rock RipRap to prevent erosion on coastal shorelines, ditches, canals, and areas where higher turbulent water flow and/or wave action exists. The rock drainage layers dissipate high turbulent water flow, as well as release the energy of water pressure during wave attacks. Gabion boxes and Reno mattresses have also been utilized as drainage structures since about the nineteenth century. The gabion/reno wire cages incorporate the use of galvanized or stainless wire, either double twisted or welded together, to form wire boxes of certain lengths, widths and heights. The wire boxes or "cages" were then filled with rock, and a wire lid is utilized to close and clamp the cage to encapsulate the rocks therein. These wire box systems have been utilized worldwide to successfully protect steep slopes, channels, landfill chutes, and many other applications from erosion.

Drainage layers have also long been known to affectively increase the hydraulic stability when used with articulated concrete block systems. Examples of applications include areas that experience high water velocities, hydraulic jumps, shoreline wave attacks, and landfill down chutes. Rock drainage layers placed underneath articulated concrete block systems primarily include smaller 1 to 1.5 inch size rock having a thickness generally of about 6 inches. Before installing the drainage rock layer, a geosynthetic material is placed on the ground, a 6 inch rock drainage layer is installed, another geosynthetic layer is overlaid thereon, then the articulated concrete block system is installed on top. Rock drainage layers employed today incorporate the use of a woven mesh underneath the rock, to be used in conjunction with articulated concrete block systems. The entire system is then anchored to steep slopes with percussion driven earth anchors to stabilize the slopes.

A revetment system identified by U.S. Pat. No. 10,113,285 by Nadeau illustrates a revetment system incorporating the use of a cellular confinement structure that is overlaid by an articulated concrete block system. This system failed to achieve the ability to utilize the much-needed use of larger rock stone sizes, such as 3×5 inch bull rock, 6 inch or even 9 inch rock riprap as the first drainage layer, then the smaller 1-1.5 inch rock layer for a final grade to support the articulated concrete block system. Described in this patent are plastic cells that are filled with a backfill that may include sand, topsoil, or other material such as aggregate. Common aggregate size is $D_{50}$ (¾ inch) while other alternate aggregate could be $D_{50}$ stone of ⅜ inch to 1.5 inch size. This is due to the size and limitation of the cellular confinement shapes of the individual pockets or areas where the backfill is placed. Therefore, this type of multi-layer system is described as being limited to the use of smaller aggregate sizes, i.e., 0.75 to 1.5 inch.

The Nadeau confinement system has no bottom or top, but only perforated walls to confine the aggregate from moving in a lateral direction. The cellular confinement system obtains its vertical strength from the aggregate filling the same. In other words, once the cellular confinement system is filled with aggregate, heavy equipment can be driven over it, but not before it is filled with the aggregate.

An example of a rock drainage layer technology is a completed project for a home owner on Lake Sam Rayburn, Tex. This project design was submitted to the U.S. Army Corps of Engineers, Fort Worth, Tex. District, for review and approval prior to any work commencing by the homeowner. This project included a geotextile filter fabric first installed on the subgrade, a geogrid layer, 6 inch depth of a 3×5 inch bull rock, 1-2 inches of smaller 0.75-1.5 inch aggregate, another geogrid layer, and an 8 inch open cell articulated concrete block system. All layers were hand laid without using cables in the ACB system. The voids of the articulated concrete block were then back-filled with the 1 inch small aggregate since the application was for 6 foot wave attacks predicted and no vegetation was desired. According to information from the home owner, the USACOE allowed only two methods of approved products for use on this lake, which were large Rock Riprap or an ACB system.

The project was installed on steep slopes with limited or difficult access for the 3×5 inch drainage rock layer. Small rubber track skid steers were used to transport the rock and place it on the slope to a uniform 6 inch depth. The problem with this installation technique is that the rock kept falling or rolling down the slope. In addition, the equipment could not access all locations of the slope. This was remedied by installing the rock from the top of the slope.

In accordance with the invention disclosed herein, it was recognized there was a need for a gabion mattress with individual boxes. This would simplify the placement of the rock and allow a smoother and consistent final grade to receive thereon the articulated concrete block system. It was further recognized that once installed, a greater hydraulic stability could be achieved for better erosion protection by incorporating the wire mesh and gabion/reno structure. With this arrangement, it was recognized that percussion driven earth anchors could still be incorporated which would tie both systems together, and structurally as well, holding the entire system in place, if desired.

A problem with the Nadeau revetment system identified above is that if water undercuts the bottom layer of the flexible geosynthetic material, then the flexible material no longer rests on the ground, but falls or bows downwardly into the void formed in the eroded soil. The downward movement of the flexible geosynthetic material allows the aggregate contained by the confinement system to also fall downwardly to fill the void caused by the underlying eroded soil. This fault can cause a chain reaction in which the aggregate from the other confinement cells washes away and the revetment system is no longer able to prevent further erosion.

Other similar layered revetment systems utilizing cellular-type confinement systems include those described in U.S. Pat. No. 7,431,536 by Benda and U.S. Pat. No. 4,572,705 by Vignon et al. These layered revetment systems suffer the same problems as does the revetment system by Nadeau, described above. Many of these cellular confinement systems have no top or bottom so that they can be easily folded up into a compact structure to facilitate storage and shipping.

SUMMARY OF THE INVENTION

The present invention relates to the incorporation of a gabion or reno mattress system with an articulated concrete block system. The use of this system increases the hydraulic stability and prevents areas of severe erosion that experience high velocity turbulent flows, hydraulic jumps, wave attacks, and landfill down chute applications with high flows.

Conventional rock drainage layers utilized today in conjunction with articulated concrete block systems have a geosynthetic material first placed on the ground, then a 6 inch rock layer placed on top. Another geosynthetic layer is then placed on top of the rock layer, followed by the articulated concrete block system. One can appreciate that on steep slopes, such as a 3:1 or 2:1 slope that if not contained, the drainage rock layer will tend to roll, migrate or fall down the slopes. The rock layers are first installed with heavy equipment; however, hand placement usually is a requirement using shovels and rakes to uniformly place the rock evenly on the slope. Prior to the placement of the articulated concrete block system, the final grade must have a top surface contour that does not deviate more than about 0.50 inch for the block protection tolerance to ensure that no blocks protrude higher and are offset from an adjacent block.

By incorporating the use of a gabion/reno mattress with the articulated concrete block system, the rock drainage layer can now be more easily installed, uniformly graded, and will also incorporate a higher hydraulic stability by the use of a welded or double twisted wire mesh as part of the overall erosion protection system. Importantly, the use of gabion/reno wire cages functions to contain the rocks therein so that it is difficult for the hydraulic forces to move the entire unit. Reno mattresses are generally 6 inches, 9 inches, or 12 inches thick (or height) and come in 6 foot wide panels, and up to 60 feet in length. Typically, the wire reno mattresses are shipped in rolls. One can easily roll out the desired length of the reno mattress wire structure, cut to the desired length for the specific application, then raise the wire side panels to provide the four sides, and tie the corners using hog-tie rings. The reno mattresses also have dividers within the wire cage, on 3 feet spacings. This provides a 3×3 foot box or compartment within the 6 foot width and lengths to form uniform shaped individual wire boxes. The wire material from which the mattresses are constructed allows the structure to be self sustaining and will not distort when filled with rock or aggregate. An advantage of this structure is the ease by which 6 inch drainage rock can be placed within the wire cage, the ability to hold up more easily on steep slopes, allow faster rock placement within the wire boxes, and also achieve a more consistent and smoother final grade for the articulate concrete block system.

Depending on the erosion protection application, different size reno mattresses can be incorporated together to cover a larger area to be protected from erosion. For example, a 6 or 9 inch high reno mattress can be utilized depending on how the water velocity and hydraulic jumps are for landfill applications. For shoreline and wave attacks, larger reno mattresses of 9 inch or even 12 inch height could be utilized to help dissipate heavy wave action energy. In conventional reno mattress, larger rock is placed in the boxes, such as 3×5 inch bull rock and even 6 to 9 inch rock size when using larger depth reno mattresses. The final or top 1 to 2 inch layer in the reno mattress can be filled with a smaller 1-1.5 inch rock. This will allow a uniform top final grade for the articulated concrete block system to be placed on top of the reno mattress drainage layer. As noted above, the top layer of smaller rock can be installed and leveled within the 0.50 inch projection height tolerance.

The use of reno mattress of this type does not require a top closure lid. Since the reno mattress drainage rock is primarily used underneath the articulated concrete block system, a wire closure lid for the reno mattresses is not necessary. In contrast, a lid is necessary and standard for all other routine reno mattress applications that do not employ an overlying articulated concrete block system.

The final layer according to the preferred embodiment includes an articulated concrete block system that is installed on top of the reno mattress drainage layer. The articulated concrete block system can be of the cabled pre-assembled mat type, a non-cabled hand installed articulated concrete block type, or a cabled hand placed articulated concrete block system. In the preferred embodiment, an articulated concrete block of the type described in U.S. Pat. No. 8,678,705 by Smith is well suited for this application. Many other types and shapes of blocks can be utilized as the top concrete block system. It should be understood that water drains through the concrete blocks via the spaces between the concrete blocks, as well as through the hole(s) formed through the blocks. The drainage water then flows into the reno mattresses without eroding the underlying ground.

According to an embodiment of the invention, disclosed is a method of installing an erosion prevention product. The method includes installing a wire cage over a surface to be protected from erosion, and filling the wire cage with a coarse material. Erosion control blocks are installed over the surface of the rocks filling the wire cage.

According to a further embodiment of the invention, disclosed is a method of installing an erosion prevention product. The method includes installing a geotextile material on the ground surface to be protected from erosion, and installing a geogrid netting material over the geotextile material. Wire cages are placed over the geogrid netting material so that respective bottom wire portions of the wire cages engage the geogrid netting material, whereby the bottom wire portions contain material placed in the wire cages. A rock material is used to substantially fill each wire cage, whereby the rock material in a bottom portion of the wire cages engages the geogrid netting material to resist lateral movement of the rock material-filled wire cages. A fine aggregate is spread over a top surface of the rock material filling the wire cages and the fine aggregate is leveled. A mat of concrete erosion control blocks is installed over the leveled top surface of the rock-filled wire cages.

According to an embodiment of the invention, disclosed is an erosion prevention product, which includes a geotextile material placed on the ground surface to be protected from erosion, and a geogrid netting material placed over the geotextile material. One or more wire cages are installed over the geogrid netting material so that respective bottom wire portions of the wire cages engage the geogrid netting material, whereby the bottom wire portions contain material placed in the wire cages. A rock material substantially fills each of the wire cages, whereby the rock material in a bottom portion of the wire cage engages the geogrid netting material to resist lateral movement of the rock material-filled wire cages. A fine aggregate is spread and leveled over a top surface of the rock material filling the wire cages. A mat of concrete erosion control blocks is placed over the leveled top surface of the rock-filled wire cages.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
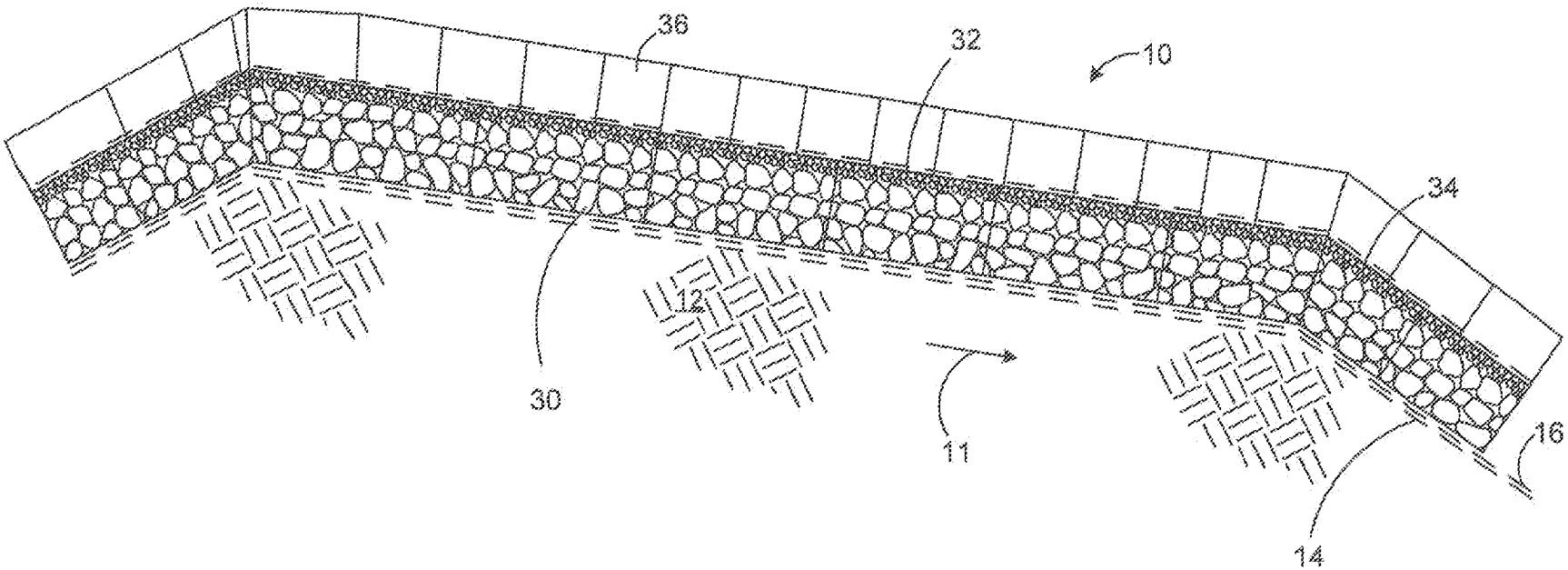
FIG. 1 is a cross-sectional view of the layered erosion control system according to an embodiment of the invention.
Figure 2:
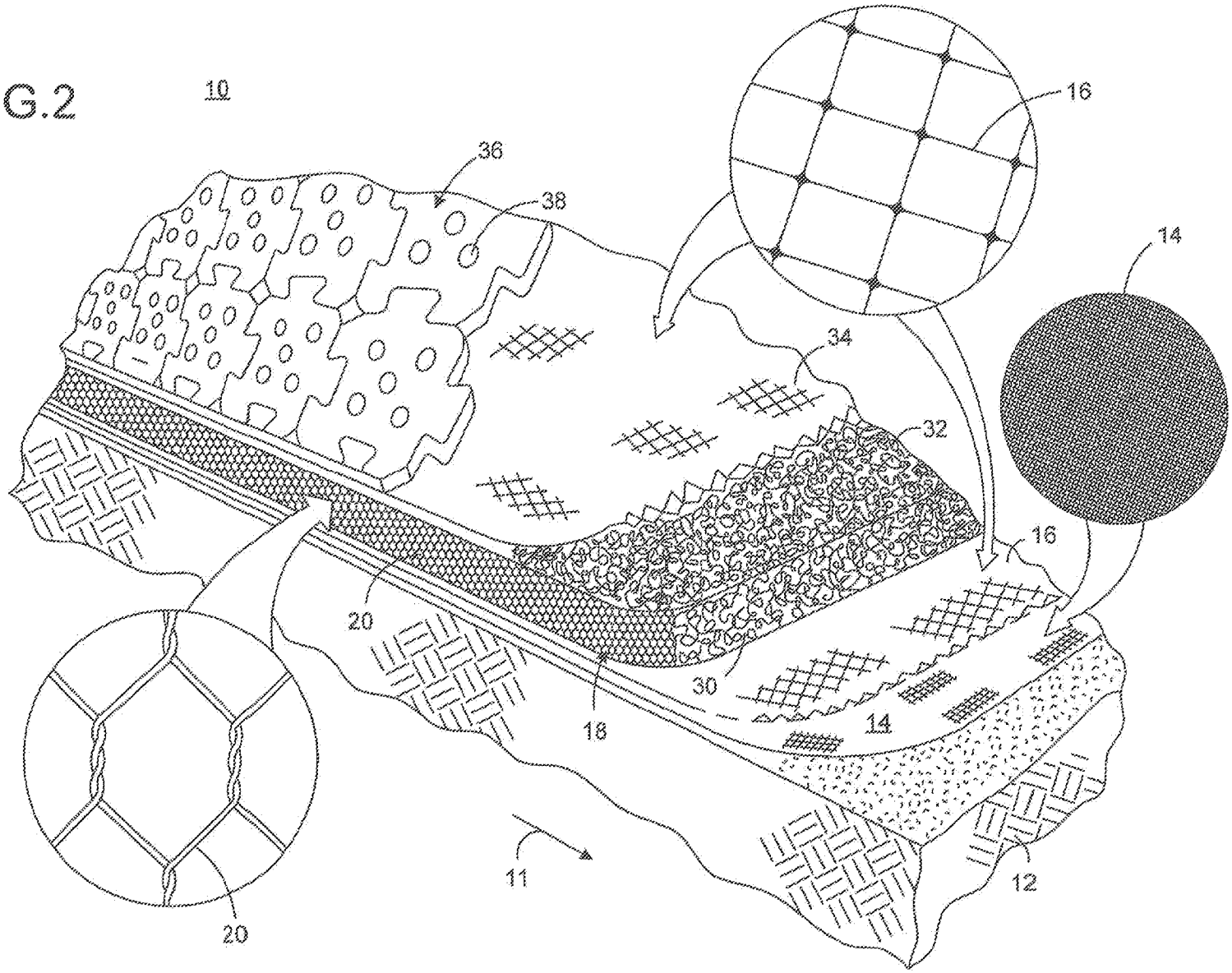
FIG. 2 is an isometric view of the various layers of the erosion control system of FIG. 1.

FIGS. 1 and 2 illustrate an example of the use of the system components according to an embodiment of the invention. The integrated reno/gabion mattress and articulated erosion control block system 10 is well adapted for use on slopes where it is desired to protect the ground from erosion due to heavy rains and wave action in lakes, rivers, shores, dams, berms, etc. The terms "reno" and "gabion" are used herein as interchangeable structures and terms. The system 10 illustrated is installed on a slope 11. Initially, the ground 12 is worked to remove any ridges and valleys and make the surface sufficiently smooth. This can be accomplished by workers using either hand equipment, or using motorized equipment, or both. The surface of the ground 12 can be smoothed so that the surface texture or contour deviates in height no more than about 0.5 inch. However, the necessity of smoothing the ground surface is not as critical with the revetment system of the invention, as the wire cage gabions (described below) can accommodate rougher ground surfaces, it being realized that the top aggregate fill of the wire cage gabions can be smoothed to the required surface contour. Nevertheless, the ground surface contour is specified in many job specifications, and is standard in the industry.

Next, the smoothed ground 12 is covered with a conventional geotextile 14 that is either woven or non-woven to allow water to pass therethrough. In practice, a non-woven geotextile material is utilized. The geotextile layer 14 is sufficiently tough so as not to be easily punctured or torn during installation and actual use. The geotextile material 14 suitable for use with the invention can be obtained from TenCate Mirafi or Propex Global Solutions. An enlargement of the tightly-woven geotextile material 14 is illustrated in FIG. 2. The non-woven geotextile material 14 is fabricated in rolls of about twelve feet wide and three hundred feet long and trucked to the work site. The non-woven geotextile material 14 can also be obtained in rolls of fifteen foot wide by three hundred feet long. The rolls of the geotextile material 14 are unrolled to cover the smooth surface of the ground 12, either up/down the slope 11, or laterally across the slope 11. The edges of the geotextile material 14 can be staked down permanently using conventional stakes (not shown) hammered into the ground 12. Overlapping the elongate edges of the strips of geotextile material 14 is customary to assure that complete coverage of the underlying ground 12 is obtained. A single row of stakes is used to anchor the overlapped edges of the geotextile material 14 to the ground 12.

A geogrid netting material 16 is installed over the geotextile material 14. The geogrid netting 16 constitutes a first netting layer, as a subsequent top geogrid netting material is optional and can also be employed. Those skilled in the art may also find that the lower geogrid netting material layer 16 is unnecessary, whereupon the gabion mattress can be laid directly on the prepared ground. The geogrid netting material 16 is a conventional synthetic mesh netting with large openings, typically openings of about 1.0 inch by 1.3 inch. The purpose of the geogrid netting material 16 is to engage with the overlying rock layer (to be described below) and prevent lateral movement or migration of the caged rock layer. The geogrid netting material 16 is constructed with strands of a synthetic plastic so that it is sturdy and tough, with openings therein sufficient such that the netting material becomes lodged with the rough surface of the rocks, and prevents lateral movement of the rocks. Typical geogrid netting material 16 suitable for use with the invention is identified as TX120 475 and can be obtained from Tensar International Corporation in rolls having a width of about 13.12 feet and 246 feet long. An enlargement of the geogrid netting material 16 is illustrated in FIG. 2. As can be appreciated, the openings in the geogrid netting material 16 are related to the size of the rock being stabilized in the gabion mattress. Like the geotextile material 14, the geogrid netting material 16 is unrolled by workmen to completely cover the geotextile material 14, or to at least cover the area that is to be overlaid with rocks. The geogrid netting material 16 may or may not be anchored at its edges with stakes or other mechanisms well known in the field. The geogrid netting material 16 can be installed or unrolled in alignment with the lengths of the strips of geotextile material 14, or perpendicular thereto.

Figure 3:
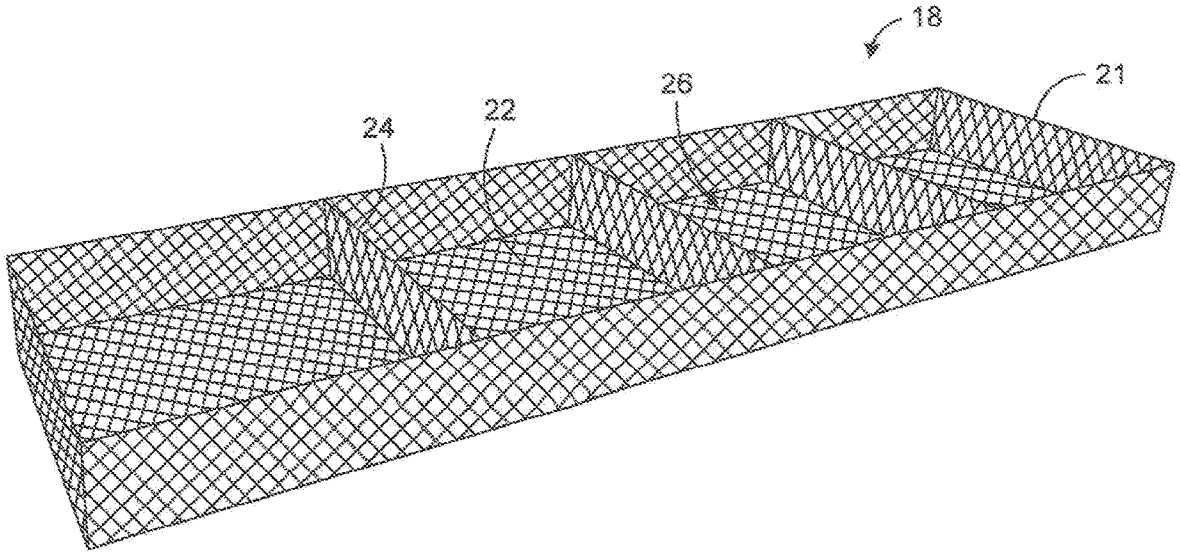
FIG. 3 is an isometric view of a gabion mattress employed according to the invention.

Once the geogrid netting material 16 is installed, then the wire cage gabion mattresses are installed over the synthetic geogrid netting material 16. A wire cage gabion 18 suitable for use with the invention is illustrated in FIG. 3. Other wire cages suitable for use can be utilized. The wire cage 18 is of conventional construction and constructed of a heavy gauge wire mesh 20 with horizontal and vertical wires (or diagonal wires) that are welded or twisted together to make an integral rigid box structure. An enlargement of a portion of the wire cage 18 is illustrated in FIG. 2. The wire gauge is sufficient so that the rocks placed therein, of whatever size, do not distort the box-like shape of the cage 18. Of course, with larger rocks placed in the wire cages 18, larger wire mesh holes can be used, and a larger gauge wire for the cages 18 would be employed as well. Conversely, with smaller size rocks, the construction of the wire cages 18 can be carried out using smaller wire holes and smaller gauge wire 20. Both the reno mattress cage and the gabion mattress cage 18 can be obtained from Maccaferri Inc., Phoenix, Ariz., or other suppliers of such products.

As noted in FIG. 3, the wire cage 18 includes four upright sides, one identified as numeral 21, and with two end panels, all forming a rectangular box shape. Further included is a bottom wire panel 22, totaling five wire cage panels. In accordance with the invention, a top wire panel or lid (not shown) can be used, but is not necessary, as the overlying mat of concrete blocks 36 can function as a lid. As such, the top wire lid of the wire cage may or may not be used. Another important feature of the invention is that the wire cages all have a heavy duty wire bottom to maintain the rocks therein, even if the underlying material layers become distorted due to the erosion of the ground, generally if the erosion is confined to an area smaller than the footprint of the gabion. Accordingly, the gabion structure maintains its integrity and the overlying articulated concrete blocks 30 also remain in place to prevent erosion from water flowing over the blocks 30.

All panels of the wire cages 18 are constructed using a sturdy wire, with openings that are smaller than the general diameter of the rocks placed therein. When employed on steep slopes, the wire cage 18 can be equipped with dividers or diaphragms 24. The dividers 24 create compartments 26, each of which can be filled with rock material. The dividers 24 prevent the rocks from rolling downhill to the lower portion of the wire cage 18, and thus allow each compartment 26 to be completely filled while yet maintaining a generally level contour as the top surface thereof that is parallel to the slope 11.

As noted above, the reno/wire cage gabion 18 is fabricated in a roll and delivered to the worksite as such. At the worksite, the roll of the wire cage 18 is unrolled on the slope 11 overlying the lower or first geogrid netting material 16. Once unrolled, the four edges of the unrolled wire cage 18 are turned or bent upwards by workmen to form the sides and the ends 20, all of which are known herein as "sides". The adjacent upright edges of the sides 20 are attached together using hog-tie rings that are inserted through both upright adjacent edges and crimped together using pliers or other similar tools. It should be noted that the rolls of the wire cage material 18 are fabricated so that when bending up the four sides, the vertical dimension of the sides 20 is whatever is desired. In other words, the height of the wire cage 18 is determined by the manufacturer and ordered for the job as such.

After the sides 20 of the wire cage 18 are formed, the workmen can install the dividers 24. The number of dividers 24 can be related to the overall length of the wire cage 18. For example, reno wire cages are available in heights of about 6, 9, 12 and 18 inch. The dividers 24 are attached to the opposite sides 20 and the bottom 22 using hog-tie rings. Rather than utilizing the long rolled-type reno wire cages 18, prefabricated or preassembled reno wire cages 18 can be employed to facilitate the manual handling of the cages 18. Preassembled reno cages are available in lengths of six and twelve foot, with dividers therein. Many other dimensions of preassembled reno cages are available. The preassembled reno cages are formed in a box shape at the manufacturer, and need not be bent and formed at the worksite. The preassembled type of reno cages can be arranged together and fastened by conventional means, such as hog rings.

Once the reno/gabion wire cage 18 is completed, it can be filled with a rock material 30 of the desired size. This is illustrated in FIG. 2. The size of the rocks used is described above for various applications. Tractor-type equipment with a hydraulic-operated bucket can be employed to move the rock 30 from a truck or pile to the wire cage compartments 26 until filled substantially level with the top edges of the sides 20. The large rock material 30 functions to allow the water from waves and the like to seep out of the layered structure and not be trapped. The rock-filled wire cages 18 also reduce the turbulence of the water, waves, and the like, to prevent erosion of the underlying soil.

Importantly, smaller rock material 32 can be scattered over the top of the larger rock 30 to fill in the interstices of the large rock 30 in the wire cages 18 and provide a substantially level contour to the top surface. As noted above, it is desired to have a level top contoured surface that has irregularities no more than about 0.5 inches in height. This is to assure that the overlying articulated concrete blocks 36 have a substantially flat surface on which to rest so that the hydraulic forces of waves and the like do not dislodge the articulated concrete blocks 36. The smaller rock material 32 can be raked or otherwise worked so as to fill in the spaces of at least the top portion of the larger rock 30.

In accordance with a feature of the invention, the rock-filled wire cages 18 facilitate the stability of such structure when installed on a slope 11. The rock-filled wire cage 18 functions effectively as one large rock, and is less likely to slide down the slope, as compared to just a layer of unconfined rock. As can be appreciated, the wire cage 18 maintains the rock therein confined within the cage 18, and the entire cage 18 has to move, not just a small portion of the rocks. This contrasts with the traditional practice of using an unconfined layer of loose rock. Moreover, the individual wire cages can be installed, filled with rock, and used as a platform for motorized equipment to fill adjacent empty wire cages with rock. The individual rock-filled cages 18 are fastened together using hog-tied rings or other suitable fasteners. Other techniques for fastening either the upright edges of the wire cage sides 20 together, or adjacent wire cages 18 together include those disclosed in U.S. Pat. No. 10,738,425, the disclosure of which is incorporated herein as if fully set forth in this document.

As noted above, once a wire cage 18 is filled with the coarse rock 30 and the overlying finer rock 32, it is suitable for supporting motorized tractor-type equipment for filling adjacent empty wire cages with rock, thereby expediting the completion of the job so that workmen do not have to shovel the rock into the wire cage compartments 26. A bucket-equipped tractor with a long arm or boom can be employed to rest on a completed rock-filled wire cage 18 and repeatedly fill the bucket from an inventory of rock 30 and fill the compartments of many adjacent empty wire cages 18. Once the empty adjacent wire cages have been filled, then the tractor equipment can be moved onto another completed wire cage 18 to fill yet other wire cages 18 until the entire slope is covered with the rock-filled wire cages 18.

Once the top of the rocks filling the wire cages 18 are prepared, as described above, then a second or top geogrid netting material 34 may be installed over the completed wire cages 18. With the use of the top geogrid netting material 34 and the lower geogrid netting material 16, it can be seen that the stability of the rocks 30 and 32 filling the wire cage 18 is achieved both above and below the rock-filled wire cage 18. The top geogrid netting material 34 can be of the same type as that of the lower geogrid netting material 16, or can be a different type with different size openings and/or shapes of the openings. The top geogrid netting material 34 functions to maintain the rock in the wire cage 18 during torrential water flows, and prevents the rocks from being drawn upwardly through the holes in the articulated concrete blocks 36 due to the suction of the swift water flow.

The layered components covering the slope 11 to be protected from erosion is next worked to cover the same with articulated concrete blocks 36. Preferably, but not of necessity, the concrete blocks 36 can be articulated using the arm and socket type of block, and holes as described in U.S. Pat. No. 8,123,435 by Smith. Many other types of articulated erosion control blocks can be utilized with the invention. Also, blocks of a desired thickness can be utilized to address the type of water force encountered on the slope 11. For example, blocks of thicknesses of 4 to 12 inch, or more, can be employed to assure that the weight of the block 36 allows it to remain locked to the adjacent blocks and is not dislodged by the hydraulic force of turbulent waves and the like. The blocks 36 can be installed either by hand, i.e., by workers who individually install each block so that the arms and sockets interlock and the mat of blocks cannot be laterally dislodged. Alternatively, the blocks 36 and be arranged in a mat off site where the blocks are cabled together as a mat and installed using a crane or similar lifting equipment. When completed, the entire surface of the slope 11 includes a top covering of the articulated concrete blocks 36.

The articulated concrete blocks 36 may be of the type that have one or more holes 38 formed therethrough. In such a case, the holes 38 can be filled with a small-size aggregate. This completes the installation of various material layers to prevent erosion of the soil on a slope.

Figure 5:
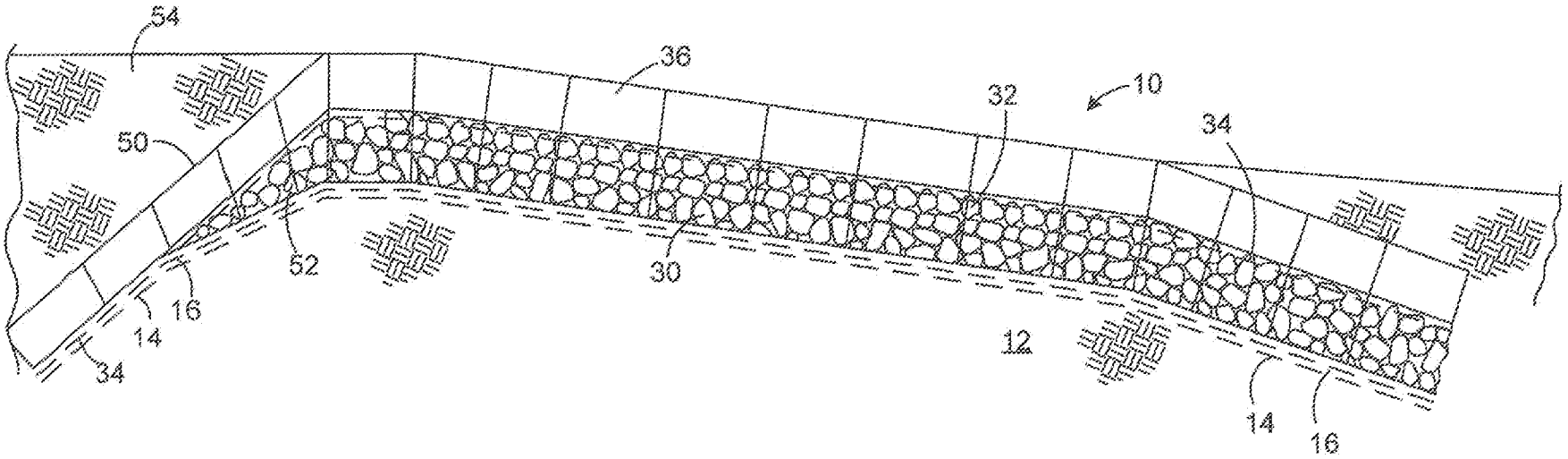
FIG. 5 is a cross-sectional view of another embodiment of the erosion control system in which the perimeter thereof is embedded in the ground.

The general area to be protected from erosion is described above. The perimeter of the area can be constructed in the manner illustrated in FIG. 5. The perimeter of the erosion protected area extends downwardly into a trench or excavated area. On the left of the drawing, the articulated concrete blocks 50 extend into an unexposed downturned perimeter trench. The upper and lower geogrid netting material 34 and 16, as well as the geotextile material 14 also extend into the trench, under the articulated concrete blocks 50. The rock-filled wire cages need not extend all the way down into the trench. It is noted that the wire cages 18 that do extend down the trench at least part of the way, can be tapered in height. Rather than utilizing the rock-filled wire cage 18, the sloped area under the concrete blocks 50 can be filled with loose rock 52 that is packed. The dirt that was excavated in forming the perimeter trench is then used to backfill the area 52 above the sloped articulated concrete blocks 50. The dirt is compacted about 95% to assure that the dirt remains in place.

The various layers of material can be installed one on top of the other as described above. Alternatively, various layers can be attached together. For example, hog-tie rings can be used to attach the lower geogrid netting material 16 to the underlying geotextile material 14. The wires comprising the bottom 22 of the wire cage 18 can be fastened to the underlying lower geogrid netting material 16. Similarly, the top geogrid netting material 34 can be attached to the underlying top edges of the wires 20 of the wire cages 18.

Figure 4:
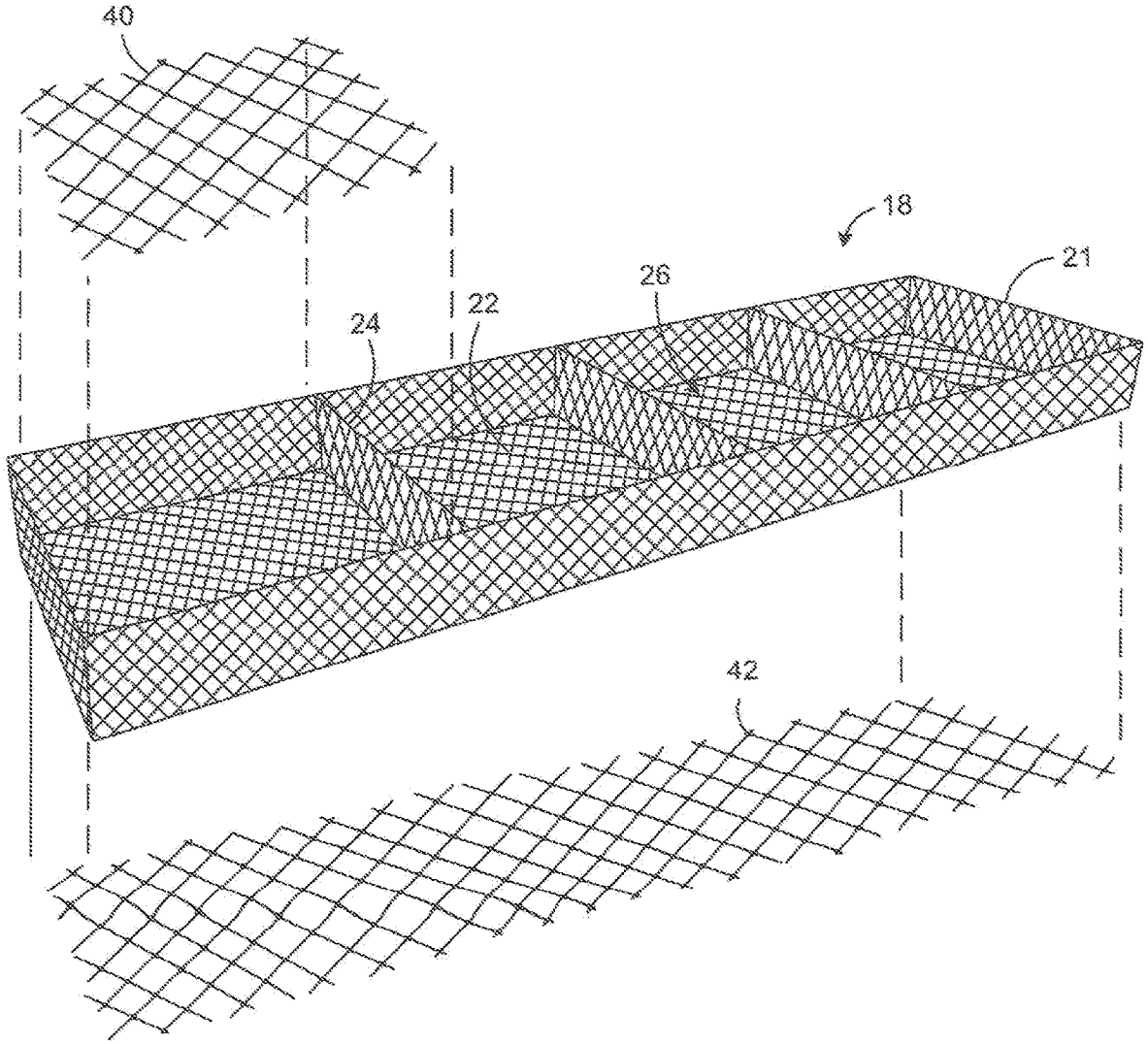
FIG. 4 is an isometric view of a gabion mattress and associated geogrid netting.

As an alternative to the installation of the rolls of the lower geogrid netting material 16, such netting can be cut into sections and attached directly to the wire cage 18. This is illustrated in FIG. 4 of the drawings. Here, a respective panel 40 of the geogrid netting material can be cut so as to fit into the bottom of each compartment 26. The panel 40 of geogrid netting may or may not be fastened to the wires 20 that form the bottom 22 of the wire cage 18. As a further alternative, a larger panel 42 of the geogrid netting material can be cut to the same size as the entire bottom of the wire cage 18, and fastened to the bottom surface of the wires 20 that form the bottom 22 of the wire cage 18. While not shown, the entire surface of all of the rock-filled wire cages 18 can be covered with the geogrid netting material, or a top panel of the geogrid netting material can be cut and attached to the top of each rock-filled wire cage 18. As noted above, the erosion control blocks 36 can be laid directly on top of the rock-filled gabion cage 18 and function as a lid.

As another alternative to the method of the invention, those skilled in the art may prefer to utilize gabion structures that need not be constructed of wire. Rather, gabion structures of a rigid plastic construction can be employed to provide boxes or compartments for holding the rock material 30 and 32. U.S. Pat. No. 10,781,569 by Thomas et al., illustrates the construction of such type of rigid gabion structures. The disclosure of such patent is incorporated herein as if fully set forth in this document.

In this instance, the empty rigid gabion structures can be installed on top of the lower geogrid netting material 16 and then filled with the rock material. Or, the rigid gabion boxes can be filled with the rock material off site, and then trucked to the site and lifted with power equipment and lowered into place on top of the geogrid netting material 16.

The wire cages described above, whether of the gabion or reno type, provide advantages over the use of perforated rigid plastic cell structures described in the prior art. The prior art plastic cellular structures do not employ top or bottom surfaces, and the sides are perforated to allow water drainage therethrough. As such, the coarse rocks do not protrude through the perforations in the rigid plastic sidewalls. With the use of wire cages, the sharp corners or protrusions can protrude through the wire openings, but still contain the coarse rocks therein. When one rock-filled cage is located adjacent to other rock-filled wire cages, the sharp corners of the rocks protruding through the wire holes engage with the sharp corners of the rocks protruding from the adjacent cages. This rough side rock profile of the cages engaging each other prevents lateral movement between the cages, even if the cages are tied together with hog-tie rings. The same is true with the rock corners protruding from the bottom wire openings, where such protrusions better engage the underlying geogrid netting to further prevent lateral movement of the rock-filled wire cages.

While the preferred and other embodiments of the invention have been disclosed with reference to specific material layers to provide a reliable erosion control system, and associated methods of fabrication and installation thereof, it is to be understood that many changes in detail may be made as a matter of engineering choices without departing from the spirit and scope of the invention, as defined by the appended claims.

What is claimed is:

1. A method of preventing erosion, comprising:

using a wire cage having wire sides and a wire bottom, and installing said wire cage over a surface to be protected from erosion;

filling the wire cage with a coarse material;

using said coarse material of a size such that at least parts of said coarse material protrude through the wire bottom of said wire cage but said coarse material remains contained in said wire cage, and so that the portion of said coarse material protruding through the wire bottom engages with an underlying material on which said wire cage is installed, whereby said coarse material-filled wire cage is stabilized against lateral movement, and if the underlying material on which said wire cage is installed erodes, said wire cage remains filled with said coarse material contained therein; and installing a plurality of erosion control blocks connected together so as to form a unit of blocks overlying a top surface of the coarse material filling the wire cage.

2. The method of claim 1, further including installing using said erosion control blocks having one or more vertical holes therein.

3. The method of claim 1, further including using the erosion control blocks as a lid for said wire cage, and using no wires of said cage as a lid.

4. The method of claim 1, wherein said coarse material comprise a rock material, and further including using an aggregate covering a top surface of said rock material, where said aggregate has a size smaller than the rock material filling said wire cage, and leveling the aggregate.

5. The method of claim 4, further including placing the aggregate on top of the rock material so as to fill in spaces between the rock material.

6. The method of claim 1, wherein plural said wire cages and said erosion control blocks comprise a revetment system, and wherein said coarse material comprises a rock material, and further including forming at least a portion of a perimeter of said revetment system by excavating said portion of the perimeter so as to form a downward extending slope, extending said rock-filled wire cages on at least a portion of said slope, extending said erosion control blocks down said slope over said rock-filled wire cages and beyond said wire cages, and overfilling the sloped erosion control blocks with a filler material.

7. The method of claim 6, further including installing a geotextile material on the ground slope before said wire cages are extended thereon.

8. The method of claim 6, further including using wire cages that taper in height down said slope.

9. The method of claim 1, further including levelling a top surface of the coarse material before installing the erosion control blocks, and placing a geogrid netting material on a top surface of said leveled aggregate.

10. The method of claim 1, further including using rocks as said coarse material, and further including selecting said netting material with each said opening having a size that allows at least a portion of said individual rock to protrude therethrough but not generally pass an individual said rock therethrough.

11. The method of claim 1, further including using said coarse material which comprises an aggregate rock that has a general diameter greater than 1.5 inches.

12. The method of claim 1, further including using a wire cage having a height of about 18 inches or less, and overlying the top of said coarse material-filled wire cage with said connected erosion control blocks to provide additional weight to said wire cages having the height of about 18 inches or less, thereby increasing the stability of said coarse material-filled wire cages.

13. A product made according to the method of claim 1.

14. A product made according to the method of claim 1, further including placing a geogrid netting material on the bottoms of said wire cage.

15. A method of preventing erosion of a sloped grade, comprising:

installing a geotextile material on the sloped ground surface to be protected from erosion;

installing a geogrid netting material over the geotextile material;

placing wire cages over said geogrid netting material so that respective bottom wire portions of said wire cages engage said geogrid netting material and said geogrid netting material prevents movement of the overlying wire cages;

using said wire cages having respective sides and bottoms and interconnecting said wire cages together, and overlying said wire cages on said sloped grade to contain a rock material placed in said wire cages so that the rock material does not migrate down the sloped grade during installation of said rock material;

using the rock material to substantially fill each said wire cage, whereby the rock material in a bottom portion of said wire cages engages said geogrid netting material to resist lateral movement of said rock material-filled wire cages and said wire cages are thereby prevented from moving down the sloped grade;

spreading a fine aggregate over a top surface of said rock material filling said wire cages and leveling said fine aggregate to provide a level surface suitable for supporting thereon erosion control blocks; and installing a plurality of said erosion control blocks interconnected together so as to form a unit over the leveled top surface of the rock material-filled wire cages.

16. The method of claim 15, wherein respective wire tops are not used to cover said wire cages.

17. The method of claim 16, further including using the erosion control blocks as interlocking erosion control blocks having interlocking arms and sockets, and installing said interlocking erosion control blocks over the leveled top surface of said rock material and using said interlocking erosion control blocks as a lid to said wire cages.

18. The method of claim 15, wherein apparatus thereof comprises a system, and further including forming a perimeter of said system, and burying said system and at least a portion of said rock material-filled wire cages underground.

19. The method of claim 15, further including using said rock material having a diameter of greater than 1.5 inch, and using said rock material having protrusions sufficient to protrude through a bottom wire mesh of said wire cages and engage the underlying geogrid netting, thereby interlocking said rock material-filled wire cages to said underlying geogrid netting.

20. An erosion prevention product, comprising:

a geotextile material on a sloped ground surface to be protected from erosion;

a geogrid netting material over the geotextile material;

one or more wire cages installed over said geogrid netting material so that respective bottom wire portions of said wire cages engage said geogrid netting material, and said geogrid netting material prevents movement of the overlying wire cages;

a rock material substantially filling each said wire cage, whereby the rock material in a bottom portion of said wire cages engages said geogrid netting material to resist lateral movement of said rock material-filled wire cages and said rock material is contained in said wire cages and is thereby prevented from moving down the sloped grade;

a fine aggregate spread and leveled over a top surface of said rock material filling said wire cages, said level surface suitable for supporting thereon erosion control blocks;

a mat of interconnected said concrete erosion control blocks placed over the leveled top surface of the rock material-filled wire cages; and said one or more wire cage each having a height about 18 inches or less, and said interconnected erosion control blocks overly the top of said leveled fine aggregate to provide additional weight to said wire cages having a height of about 18 inches or less, thereby increasing the stability of said rock material-filled wire cages.

* * * * *